US005632379A

United States Patent [19]

Frost

[11] Patent Number: 5,632,379

[45] Date of Patent: May 27, 1997

[54] SANDWICH SERVING CONTAINER

[76] Inventor: John H. Frost, 6900 Canby Ave. - #110, Reseda, Calif. 91335

[21] Appl. No.: 643,318

[22] Filed: May 6, 1996

[51] Int. Cl.[6] ..... A45C 11/20

[52] U.S. Cl. ..... 206/541; 206/525; 229/902; 229/938; 426/115

[58] Field of Search ..... 206/541, 216, 206/525; 229/902, 938; 426/112, 115

[56] References Cited

U.S. PATENT DOCUMENTS

| | | | |
|---|---|---|---|
| 3,173,599 | 3/1965 | Silver | 229/122 |
| 3,613,566 | 10/1971 | Shapleigh, Jr. | 229/122 |
| 4,189,054 | 2/1980 | Liu et al. . | |
| 4,472,896 | 9/1984 | Brauner | 229/902 |
| 4,511,039 | 4/1985 | Seimek . | |
| 5,110,038 | 5/1992 | Pantisano et al. | 426/115 |
| 5,148,972 | 9/1992 | Clayton | 229/938 |

*Primary Examiner*—Paul T. Sewell
*Assistant Examiner*—Nhan T. Lam
*Attorney, Agent, or Firm*—Jack C. Munro

[57] ABSTRACT

A food serving container which includes a tray which is formed by a front section and a rear section. Both the front section and the rear section have a side wall which connect together to form an enclosing side wall when the tray is in a stored position permitting a sandwich to be located and stored within the chamber of the tray. The front section is capable of pivoting relative to the rear section to an inclined position which facilitates consuming of the sandwich with the front section functioning to catch and collect any sandwich drippings that may occur doing the consuming procedure. With the front section in the usage position, the upstanding side wall of the front section is limited to the extent of movement relative to the rear section.

10 Claims, 1 Drawing Sheet

SANDWICH SERVING CONTAINER

BACKGROUND OF THE INVENTION

1) Field Of The Invention

The field of this invention relates to containers for food products and more particularly a food product which is designed to be consumed while being held in the consumers hand, more particularly, to food in the form of a sandwich being located inside of and supported by the serving container while being consumed.

2) Description Of The Prior Art

Food products which are consumed while being held in the consumers hand are extremely common. One particular common such food product is a sandwich and specifically a bun-type sandwich. These type of sandwiches are in widespread usage by fast food type of restaurants. It is common that these kinds of sandwiches are purchased by individuals from motor vehicles with the sandwich being consumed as the individual operates the motor vehicle.

Sandwiches contain bread, meat, tomatoes, dressing, ketchup, mustard, onion lettuce and other types of food materials. It is exceedingly common that during the consuming process there may be produced a dripping which may be either the bread, meat or some liquid or semi-liquid material such as a dressing. The consumer may be impeccably dressed and while consuming of the sandwich, food dripping may occur on the clothing of the individual. This can prove to be undesirable especially if the consumer is in route to an important meeting or similar type of activity.

In the past, there have been produced containers for supporting and facilitating eating of food separate from the container. Reference is to be had to U.S. Pat. No. 5,181,649, issued Jan. 26, 1993, by the present inventor, where a type of container is disclosed that has been designed for the purpose of minimizing direct contact of a sandwich with the hand or hands of the consumer and also functions to collect any food drippings from the sandwich that may occur. The sandwich serving container of the aforesaid patent, although functioning satisfactorily, was in need of improvement. There was a need to insure that all food drippings would be collected. Also, there was a need to construct a container as cheaply as possible. Additionally, it is important to construct a container in a manner so that it will not interfere with the normal consuming process of the sandwich.

SUMMARY OF THE INVENTION

The structure of the present invention is directed to a sandwich serving container which is designed to facilitate the consuming of a sandwich, generally a hamburger, directly out of the container, while eliminating any food drippings from falling free of the container and contaminating an exterior structure such as vehicle upholstery and/or clothes of the consumer. The sandwich serving container is constructed of a tray which is formed of a front section and a rear section which are pivotally connected together. The front section is movable relative to the rear section from a stored position to an inclined position. When in the stored position, the planer surface of the front section is located parallel to the planer surface of the rear section and substantially in alignment therewith. When in the stored position, the front section has an upstanding wall which connects with an upstanding wall of the rear section thereby forming a chamber within which is located the sandwich. The front section is pivotable about a dual axis relative to the rear section so that the front section not only is pivotable relative to the rear section but also is displacable to various positions relative to the rear section. The front section and rear section are connected together by an engaging structure in the form of a protuberance which rides within an enlarged opening which defines the limit of the movement of the front section relative to the rear section. The planer wall of the rear section includes an access opening which facilitates the consuming procedure.

One of the objectives of the present invention is to provide a sandwich serving container which facilitates complete consumption of the sandwich without removal from the container and without repositioning of the container during the consuming procedure.

Another objective of the present invention is to construct a sandwich serving container which can be manufactured at an exceedingly low cost thereby facilitating the disposal of the container after a single use.

Another objective of the present invention is to provide a sandwich serving container that allows the consumer to hold the sandwich inside of the container while at the same time positioning the upper and lower teeth of the consumer around the top and bottom of the sandwich with no container interference to the lips, chin or neck of the consumer as well as no interference to the consumer's ability to both grip simultaneously with one hand the sandwich and the container and to manipulate the sandwich.

DETAILED DESCRIPTION OF THE PREFERRED EMBODIMENT

Figure 1:
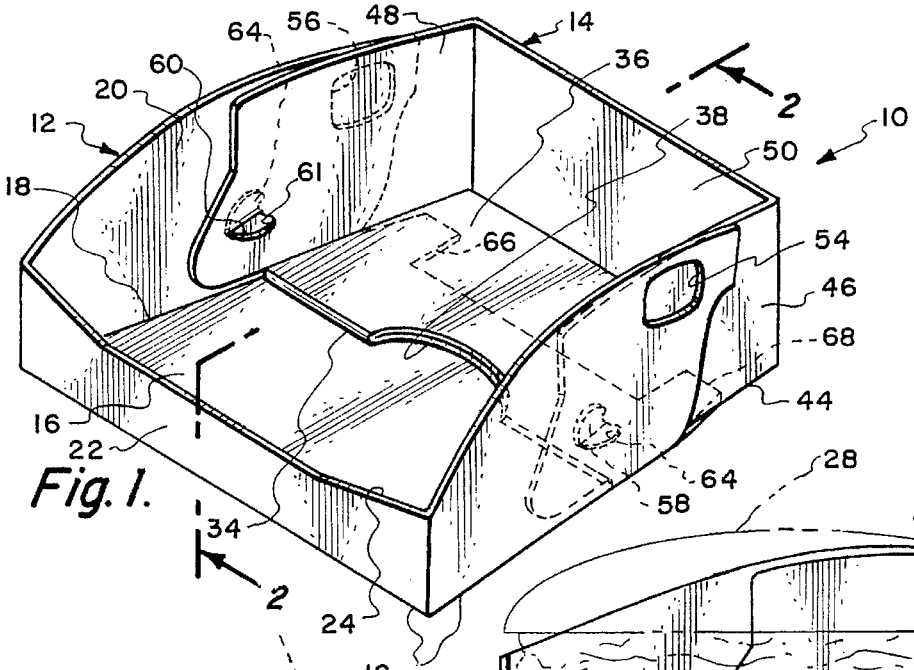
FIG. 1 is an isometric view of the sandwich serving container of the present invention showing the sandwich serving container in the stored position.

Conventional sandwich containers are designed to insulate and protect the user from spills only when the container is closed and not open. Using of the container at a table presents no problem where the user has a table available to collect any spills. However, usage of such a container by occupants in a car can be messy and usage by the driver can be dangerous. Many traffic fatalities are directly related to people eating while driving because the people in trying to prevent or to clean up spills on their clothes are forced to take their eyes off the road. It is believed that the product of this invention could save many lives each and every year within the United States.

Referring particularly to the drawing, there is shown a sandwich serving container 10 of this invention. The sandwich serving container 10 is constructed of a front section 12 and a rear section 14. Typical material of construction of the sandwich serving container 10 of this invention would be a sheet material such as paper. The front section 12 includes a planer bottom 16 which has a peripheral edge 18. Integrally connected at the peripheral edge 18 is an upstanding wall 20. The upstanding wall 20 is shown to have three sides with the planer bottom 16 being substantially rectangular. The upstanding wall 20 is non-enclosing forming an open section. The front wall 22 of the upstanding wall 20 includes a cut away section 24. The cut away section 24 is for the purpose of minimizing interference with the chin 26 of the consumer during consumption of the sandwich 28. The planer bottom 16 is pivotally connected by a first pivot joint 30 to a flap 32. The flap 32 is pivotally connected by a second pivot joint 34 to a planer bottom 36 of the rear section 14. Formed at the pivot joint 34 and located at approximately the transverse center of the planer bottom 36 is an access opening 38. It is the function of the access opening 38 to provide access for the chin 26 as well as the teeth 40 and lips 42 when consuming of the portion of the sandwich 28 that is located on the planer bottom 36. The planer bottom 36 has a peripheral edge 44 at which is integrally connected an upstanding wall in the form of side panels 46 and 48 which are interconnected by a rear wall 50.

Figure 2:
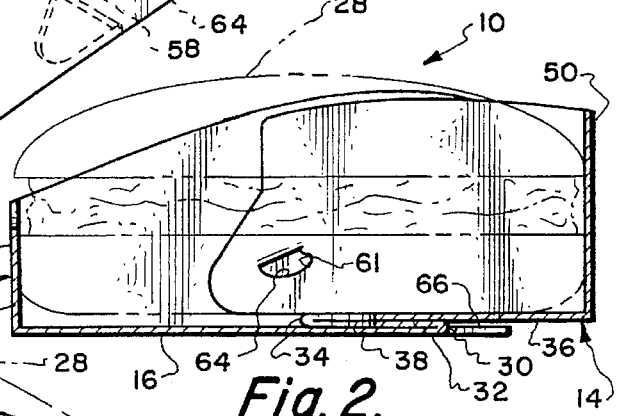
FIG. 2 is a cross-sectional view through the sandwich serving container of the present invention taken along line 2—2 of FIG. 1 depicting in phantom lines a sandwich stored within the container.

When in the stored position shown in FIG. 2, the planer bottom wall 16 is located parallel to the planer bottom 36 and only slightly misaligned therefrom. In this position, the planer bottom 16 and 36, as well as the upstanding wall 20, front wall 22, side panels 46 and 48 and rear wall 50 form an enclosing chamber within which is located the sandwich 28. Normally this sandwich 28 and container 10 will be enclosed by a paper or plastic covering which is not shown.

Figure 3:
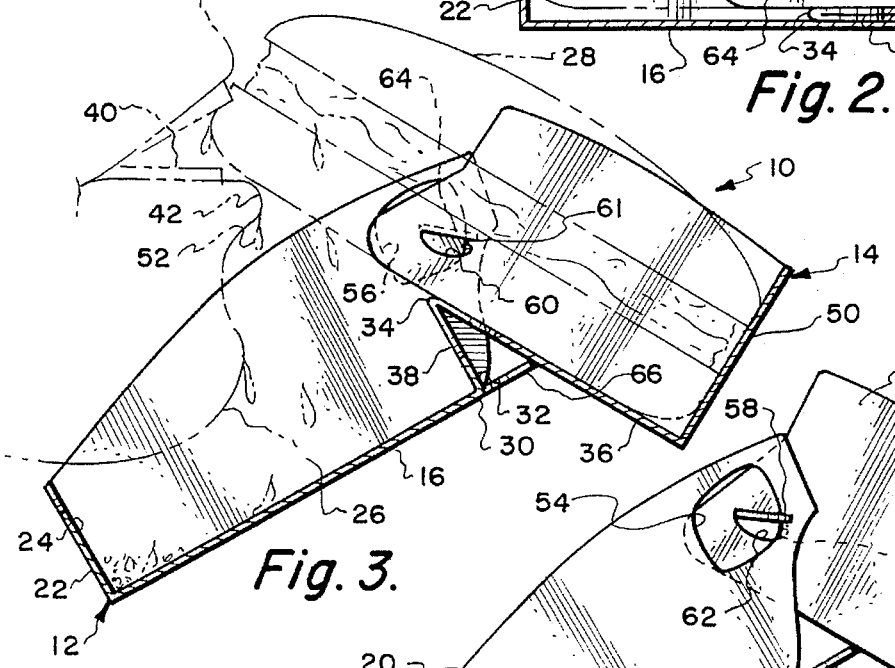
FIG. 3 is a cross-sectional view similar to FIG. 2 but showing the sandwich serving container in the usage position depicting in phantom lines a human user consuming of the sandwich.
Figure 4:
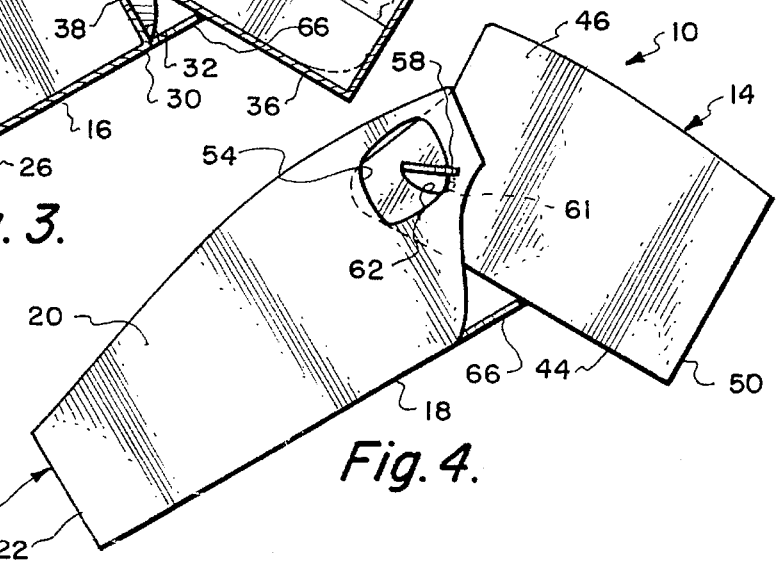
FIG. 4 is a side view of the sandwich serving container of the present invention when in the usage position.

During the consuming procedure, the covering (not shown) is to be removed. The front section 12 is capable of deflecting to an inclined position relative to the rear section 14 as is shown in FIGS. 3 and 4 When in this deflected position, the sandwich 28 is positioned to facilitate its consumption and any drippings 52 are to be caught and collected by the portion of the chamber contained within the front section 12. Thereby these drippings 52 are prevented from contaminating the environment exteriorly of the food serving container 10. Drippings 52 are to include crumbs.

The double pivot joint formed by first pivot joint 30 and second pivot joint 34 not only permits pivoting movement of the front section 12 relative to the rear section 14 but also permits complete deflection of the front section 12 relative to the rear section 14. This complete deflection is in essence lineal movement of the front section 12 relative to the rear section 14. This is desirable so as to permit the user to displace the front section 12 to a forwardly displaced position during the initial portion of the consuming procedure so as to insure that any drippings 52 will be caught and collected by the chamber formed within the front section 12.

The actual amount of movement of the front section 12 relative to the rear section 14 is defined by enlarged openings 54 and 56 formed within the side panels of the upstanding wall 20. Formed within the side panel 46 is a protuberance 58. A similar such protuberance 60 is formed within the side panel 48. Each protuberance 58 and 60 includes a hook 61 that is to laterally restrain the upstanding wall 20 when the container 10 is in the usage position shown in FIGS. 3 and 4, protuberances 58 and 60 are actually cut-out deflected sections of their respective side panels 46 and 48 forming holes 62 and 64, respectively. When the front section 12 is in the stored position with the rear section 14 protuberances 58 and 60 ride against the surface of the upstanding wall 20. However when the front section 12 is deflected relative to the rear section 14 as is shown in FIGS. 3 and 4 of the drawings, the protuberance 58 will connect with enlarged opening 54 with protuberance 60 connecting with enlarged opening 56. The protuberances 58 and 60 will then function to limit the amount of movement of the front section 12 relative to the rear section 14. It is desired to limit this movement as it would not be preferred to have the front section 12 extend too great a distance from the rear section 14. This limiting of the movement is accomplished by the protuberances 58 and 60 abutting against the wall surface of the enlarged openings 54 and 56 respectively. When the container 10 is in the usage position, the planer bottom 36 of the rear section 14 rests on the ends of tabs 66 and 68 of the planer bottom 16. When the container 10 is in the stored position, the planer bottom 36 rests flush on tabs 66 and 68, giving added support to sandwich 28 should the user mistakingly pick up container 10 by the front section 12.

After the sandwich 28 has been completely consumed, the food storage container 10 is to be discarded.

What is claimed is:

1. A sandwich serving container comprising:

a sheet material tray formed by a front section and a rear section, said front section having a first planer bottom, said rear section having a second planer bottom, said front section having a first peripheral edge, a first upstanding wall attached to said front section at said first peripheral edge, said first upstanding wall being non-enclosing having a first open section, said rear section having a second peripheral edge, a second upstanding wall attached to said rear section at said second peripheral edge, said second upstanding wall being non-enclosing having a second open section, said front section being connected to said rear section with said first open section connecting with said second open section defining a chamber enclosed by said first and second upstanding walls, said chamber being adapted to have located therein a sandwich; and engaging means mounted on said first upstanding wall and said second upstanding wall, said front section being movable relative to said rear section with said engaging means functioning to define the limits of movement of said front section relative to said rear section, said front section being movable between a stored position and a usage position, said stored position locating said first planer bottom substantially parallel to said second planer bottom, said usage position locates said first planer bottom at an inclined angle relative to said second planer bottom, whereby a sandwich is to be storable within said chamber when said front section is in said storage position, when said front section is in said usage position the sandwich is to be located to be consumed with said front section functioning to catch and collect any sandwich drippings that may occur during the consuming procedure.

2. The sandwich serving container as defined in claim 1 wherein;

said front section being pivotally connected to said rear section.

3. The sandwich serving container as defined in claim 2 wherein;

said front section being connected to said rear section by a double pivot joint composed of a first pivot joint and a second pivot joint.

4. The sandwich serving container as defined in claim 3 wherein:

said first pivot joint being connected to said first planer bottom.

5. The sandwich serving container as defined in claim 4 wherein:

a portion of said first planer bottom defined as tabs extends rearward past said first pivot joint providing support for said second planer bottom when in said stored position.

6. The sandwich serving container as defined in claim 5 wherein:

said tabs being spaced apart allowing accessibility for finger support at said access opening.

7. The sandwich serving container as defined in claim 1 wherein;

said engaging means being located in a disengaged position when said front section is in said stored position.

8. The sandwich serving container as defined in claim 1 wherein;

said engaging means comprising a protuberance positioned within an enlarged hole, the size of said enlarged hole defines the extent of movement of said front section relative to said rear section.

9. The sandwich serving container as defined in claim 8 wherein:

said protuberance having a hook which is to provide lateral restraint for said first upstanding wall and said second upstanding wall.

10. The sandwich serving container as defined in claim 1 wherein;

said second planer bottom including access opening, said access opening providing clearance for the users mouth and chin during the consuming procedure and providing access for the user's thumb to be able to manipulate the sandwich.

* * * * *